US010758940B1

(12) United States Patent
Young

(10) Patent No.: US 10,758,940 B1
(45) Date of Patent: Sep. 1, 2020

(54) MOBILE SIEVING APPARATUS AND METHOD FOR HARVESTING CANNABIS POLLEN AND TRICHOMES

(71) Applicant: Christopher J. Young, Eagle Point, OR (US)

(72) Inventor: Christopher J. Young, Eagle Point, OR (US)

( * ) Notice: Subject to any disclaimer, the term of this patent is extended or adjusted under 35 U.S.C. 154(b) by 165 days.

(21) Appl. No.: 16/211,306

(22) Filed: Dec. 6, 2018

Related U.S. Application Data

(60) Provisional application No. 62/637,140, filed on Mar. 1, 2018.

(51) Int. Cl.
*B07B 1/02* (2006.01)
*B07B 1/00* (2006.01)
*B07B 1/46* (2006.01)

(52) U.S. Cl.
CPC ..... *B07B 1/005* (2013.01); *B07B 1/4672* (2013.01); *B07B 2201/04* (2013.01)

(58) Field of Classification Search
CPC ... B07B 1/005; B07B 1/4672; B07B 2201/04; B07B 1/4663; B07B 1/02
USPC ..... 209/311, 319, 402, 403
See application file for complete search history.

(56) References Cited

U.S. PATENT DOCUMENTS 786,019 A 3/1905 Flesher
1,141,727 A 6/1915 Seaman
1,430,636 A 10/1922 Forgeson
2,075,097 A 3/1937 Dawes et al.
3,386,580 A 6/1968 Grabarczyk
3,800,943 A 4/1974 Riesbeck et al.
4,199,442 A * 4/1980 Popow ..... B07B 1/02 209/355
4,233,151 A 11/1980 Gundlach
4,289,241 A 9/1981 Litrap
4,307,808 A 12/1981 Johnson
4,371,436 A 2/1983 Farber
4,381,669 A 5/1983 Peters
4,848,607 A 7/1989 Halley
5,222,605 A 6/1993 Pogue
5,242,058 A 9/1993 Jones
(Continued)

FOREIGN PATENT DOCUMENTS

CN 201341343 11/2009
RU 2231401 6/2004

*Primary Examiner* — Patrick H Mackey
(74) *Attorney, Agent, or Firm* — Jerry Haynes Law

(57) ABSTRACT

A mobile sieving apparatus and method for harvesting cannabis pollen and trichomes separates the flowers of a cannabis plant. A large sieve panel, a medium sieve panel, a small sieve panel, and a silk screen panel are arranged in a spaced-apart stacked arrangement inside a harvesting vehicle. The sieved panels have different sized openings to enable passage of corresponding portions of the cannabis plant. The sieve panels are arranged by graduated separation, in which the distance between panels correlates to the size of the cannabis plant components passing through the opening. A harvesting panel has a solid, flat surface, and positions below the sieve panels to catch the pollens and trichomes falling through. The panels are stacked in a harvesting vehicle, sliding onto docking rails that slidably receive the edges of panels. The harvesting vehicle is lightweight to enable manual agitation of the vehicle, and enhance mobility of the panels.

20 Claims, 5 Drawing Sheets

(56) References Cited

U.S. PATENT DOCUMENTS

| | | | | |
|---|---|---|---|---|
| 5,368,169 | A | 11/1994 | Ensor | |
| 5,423,430 | A * | 6/1995 | Zaffiro | B07B 1/02 209/315 |
| 5,733,592 | A | 3/1998 | Wettstein et al. | |
| 6,220,448 | B1 | 4/2001 | Bakula et al. | |
| 6,267,310 | B1 | 7/2001 | Cappola | |
| 6,371,305 | B1 | 4/2002 | Austin et al. | |
| 6,925,857 | B2 | 8/2005 | Weber et al. | |
| 7,987,990 | B2 * | 8/2011 | Srivatsan | A63H 33/04 209/355 |
| 8,113,355 | B1 * | 2/2012 | Peterson | B07B 1/06 209/235 |
| 8,640,877 | B1 | 2/2014 | Pastorius | |
| 8,646,614 | B2 * | 2/2014 | Peterson | B03B 5/02 209/235 |
| 9,095,881 | B2 * | 8/2015 | Rieck | B07B 1/28 |
| 9,205,458 | B2 | 12/2015 | Gandhi et al. | |
| 2013/0213862 | A1 * | 8/2013 | Peterson | B03B 5/26 209/235 |
| 2016/0108555 | A1 * | 4/2016 | Rosado | B07B 1/06 209/409 |
| 2016/0158803 | A1 | 6/2016 | Rosado | |
| 2019/0255570 | A1 * | 8/2019 | Koerner | B07B 1/02 |

* cited by examiner

MOBILE SIEVING APPARATUS AND METHOD FOR HARVESTING CANNABIS POLLEN AND TRICHOMES

CROSS-REFERENCE TO RELATED APPLICATIONS

This application claims the benefits of U.S. provisional application No. 62/637,140, filed Mar. 1, 2018 and entitled MOBILE CANNABIS POLLEN AND TRICHOMES RECOVERY APPARATUS AND METHOD OF HARVESTING POLLEN AND TRICHOMES, which provisional application is incorporated by reference herein in its entirety.

FIELD OF THE INVENTION

The present invention relates generally to a mobile sieving apparatus and method for harvesting cannabis pollen and trichomes. More so, the present invention relates to an apparatus and method for harvesting pollen and trichomes that separates flowers, trimmings, pollen, and trichomes of a cannabis plant with sequential sieving through a stacked arrangement of graduated sieved panels arranged by graduated separation, and a harvesting panel that collects the pollen and trichomes that pass through all the sieved panels; and further carries the panels in a harvesting vehicle that is lightweight to enhance agitation and mobility.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, cannabis plants grow in a bush configuration, which often includes intertwined stems with leaves and buds. The stems of the cannabis plant do not contain the consumable portion of the cannabis plant. Therefore, when harvesting the cannabis plant, the leaves and buds are separated from the undesirable stems. Conventional manual processes for the separating step include holding the stem with one hand while simultaneously pulling off the leaves and buds with the opposite hand or cutting the buds from the stem with scissors.

Generally, cannabis plants can be harvested and processed to obtain numerous kinds of chemical compounds used in medical products. The compound tetrahydrocannabinol (THC) can be extracted from cannabis plants. In particular, THC can be obtained by refining micron-sized outgrowths on the cannabis plant called trichomes. Trichomes may vary in size (e.g., between 60 to 200 microns).

Generally, the pollen and trichomes harvested from cannabis plant is a fine to coarse powder containing the micro gametophytes of seed plants, which produce the male gametes (sperm cells). Pollen and trichomes grains have a hard coat that protects the sperm cells during the process of their movement between the stamens to the pistil of flowering plants or from the male cone to the female cone of coniferous plants. When pollen and trichomes lands on a compatible pistil of flowering plants, it germinates and produces a pollen and trichomes tube that transfers the sperm to the ovule of a receptive ovary.

Consequently, the individual pollen and trichomes grains are small enough to require magnification to see detail. For cannabis pollen and trichomes, once the male cannabis plants begin to flower, the pollen and trichomes can be harvested. If the female plant is feminizing its seeds, the pollen and trichomes can also be harvested. For example, as soon as the pollen and trichomes sacs begin cracking on the marijuana plant as if to open, the pollen and trichomes is ready for harvesting Other proposals have involved systems for harvesting cannabis plants. The problem with these harvesting systems is that they are not easy to manually agitate or carry to the cannabis plant or field. Also, the sieves are not stacked in a graduated arrangement, so as to optimize space in the harvesting vehicle carrying the sieve panels. Even though the above cited systems for harvesting cannabis plants meet some of the needs of the market, a mobile sieving apparatus and method for harvesting cannabis pollen and trichomes that separates flowers, trimmings, pollen, and trichomes of a cannabis plant with sequential sieving through a stacked arrangement of graduated sieved panels arranged by graduated separation, and a harvesting panel that collects the pollen and trichomes that pass through all the sieved panels; and further carries the panels in a harvesting vehicle that is lightweight to enhance agitation and mobility, is still desired.

SUMMARY

Illustrative embodiments of the disclosure are generally directed to a mobile sieving apparatus and method for harvesting cannabis pollen and trichomes. In some embodiments, the sieving apparatus and method is configured to separate the flowers of a cannabis plant prior to trimming. The mobile sieving apparatus provides sequential sieving of the cannabis plant through a stacked, graduated arrangement of sieve panels. A large sieve panel, a medium sieve panel, a small sieve panel, and a silk screen panel are arranged by a graduated separation that accommodates the different sizes of cannabis plant portions falling through the sieve panels.

The sieved panels have different sized openings to enable passage of corresponding portions of the cannabis plant. Thus, the flowers, trimmings, leaves, pollen, and trichomes of the cannabis plant pass through a correspondingly sized hole in each sieve panel. The sieve panels are defined by a graduated separation, in which the distance between panels correlates to the size of the flower, trimming, leaf, pollen, or trichomes passing through the holes. A harvesting panel having a solid, flat surface positions below the other panels to catch the smallest pollens and trichomes that fall through the sieve openings.

In some embodiments, the panels are stacked in an elongated harvesting vehicle. The harvesting vehicle is defined by sidewalls having a series of spaced-apart docking rails that slidably receive the edges of the panels to enable efficient assemblage, replacement, and interchangeability of panels in the stacked arrangement. The harvesting vehicle is sufficiently lightweight to facilitate agitating the harvesting vehicle to create the separation on the panels. The harvesting vehicle also facilitates carrying, pulling, and pushing the harvesting vehicle while carrying the sieved panels after the cannabis plant has been cut and dried and the flowers removed from the stems.

In another aspect, the distance between the large sieve panel and the medium sieve panel is about 4".

In another aspect, the distance between the medium sieve panel and the small sieve panel is about 4".

In another aspect, the distance between the small sieve panel and the silk screen sieve panel is about 3".

In another aspect, the distance between the silk screen panel and the harvesting panel is about 1".

In another aspect, the panels have dimensions about 32⅛" long and a 16" wide.

In another aspect, the elongated harvesting vehicle has dimensions of about 17¼" in height, and a width of about 32⅝".

In another aspect, the sieved panels are fabricated from a rigid polymer.

In another aspect, the elongated harvesting vehicle is fabricated from a rigid polymer.

In another aspect, the sieve panels are fabricated from a rigid polymer, wood, and a lightweight metal, or combinations thereof.

One objective of the present invention is to sieve a cannabis plant through a graduated series of sieved panels, so as to harvest pollen and trichomes from the flowers/trimmings of the cannabis plant.

Another objective is to provide four differently sized sieve openings that separate the cannabis plant for harvesting the pollen and trichomes.

Yet another objective is to allow for easy sliding in and out of the sieve panels through docking rails, so as to enable interchangeability and easy access for repairing and replacing the sieve panels.

Yet another objective is to provide the sieve panels with edges that easily slide, or snap into the docking rails of the harvesting vehicle.

Yet another objective is to fabricate the elongated harvesting vehicle from a lightweight material, so as to facilitate manual agitation of the harvesting vehicle, and thereby separation of the cannabis plant through the sieve panels.

Yet another objective is to fabricate the elongated harvesting vehicle from a lightweight material, so as to enable an operator to drag, push, or carry the harvesting vehicle and contained panels after the cannabis plant has been cut and dried and the flowers removed from the stems, such that the harvesting vehicle is not actually carried to the actual standing cannabis plant.

Yet another objective is to fabricate the harvesting panel from a lightweight material, so as to enable facilitated collection of the pollen and trichomes.

Yet another objective is to provide an easy to operate sieving apparatus for harvesting pollen and trichomes from the cannabis flower.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
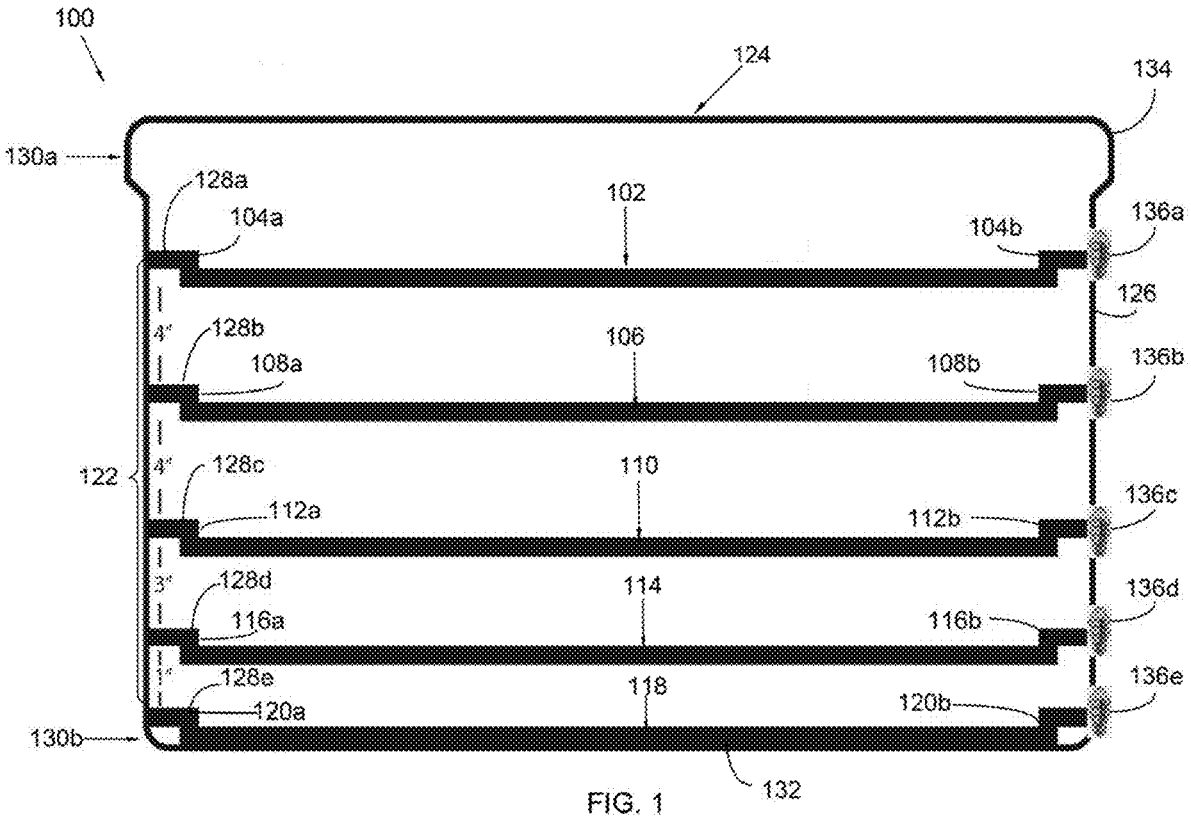
FIG. 1 illustrates a sectioned side view of an exemplary mobile sieving apparatus for harvesting cannabis pollen and trichomes, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A mobile sieving apparatus 100 and method 700 for harvesting cannabis pollen and trichomes is referenced in FIGS. 1-7B. The mobile sieving apparatus 100, hereafter "apparatus 100", is configured to provide a lightweight, mobile cannabis pollen and trichomes harvester that separates the flowers of a cannabis plant prior to trimming for the purpose of characterizing the size distribution of the flowers by separating the flowers into large, medium, and small sizes, to enable harvesting the pollen and trichomes from the smallest flowers of the cannabis plant.

Specifically, the apparatus 100 processes the flowers from a cannabis plant with sequential filtration through a graduated, stacked arrangement of sieve panels. The sieved panels have different sized openings to enable passage of corresponding portions of the cannabis plant; whereby the flowers, trimmings, leaves, pollen, and trichomes of the cannabis plant pass through a correspondingly sized hole in each sieve panel. The sieve panels 102, 106, 110 and the silk screen panel 114 are defined by a graduated separation 122, in which the distance between panels correlates to the size of the flower, trimming, leaf, pollen, or trichomes passing through the holes.

A harvesting panel is defined by a solid, flat surface. The harvesting panel positions below the sieve panels to catch the smallest pollens and trichomes that fall through the sieve openings. A harvesting vehicle slidably receives and retains the panels in the stacked, graduated spaced-apart arrangement. The lightweight configuration of the harvesting vehicle facilitates agitating the panels for sieving, and carrying the panels to and from the cannabis plant.

Those skilled in the art will recognize that pollen and trichomes is a fine to coarse powder containing the micro gametophytes of seed plants, which produce the male gametes (sperm cells). Pollen and trichomes grains have a hard coat that protects the sperm cells during the process of their movement between the stamens to the pistil of flowering plants or from the male cone to the female cone of coniferous plants. When pollen and trichomes lands on a compatible pistil of flowering plants, it germinates and produces a pollen and trichomes tube that transfers the sperm to the ovule of a receptive ovary.

Consequently, the individual pollen and trichomes grains are small enough to require magnification to see detail. For cannabis pollen and trichomes, once the male cannabis plants begin to flower, the pollen and trichomes can be harvested. If the female plant is feminizing its seeds, the pollen and trichomes can also be harvested. For example, as soon as the pollen and trichomes sacs begin cracking on the marijuana plant as if to open, the pollen and trichomes is ready for harvesting.

As referenced in FIG. 1, the sieving apparatus 100 is configured to separate the flowers of a cannabis plant prior to trimming through use of a stacked arrangement of graduated sieve panels having large, medium, and small sieve openings 400; and a silk screen panel 114 having micro-sized sieve openings 500 to catch all but the smallest pollen and trichomes. A harvesting panel 118 beneath the silk screen panel 114 catches the pollen and trichomes, and is sufficiently lightweight, so as to enable facilitated removal for collecting the pollen and trichomes. A lightweight harvesting vehicle 124 is used to carry and agitate the panels. The harvesting vehicle 124 has a series of longitudinally spaced-apart docking rails 128*a-e* that slidably receive the panels in the stacked arrangement. In this manner, panels are interchangeable, replaceable, and easily carried to and from cannabis plants.

Figure 2:
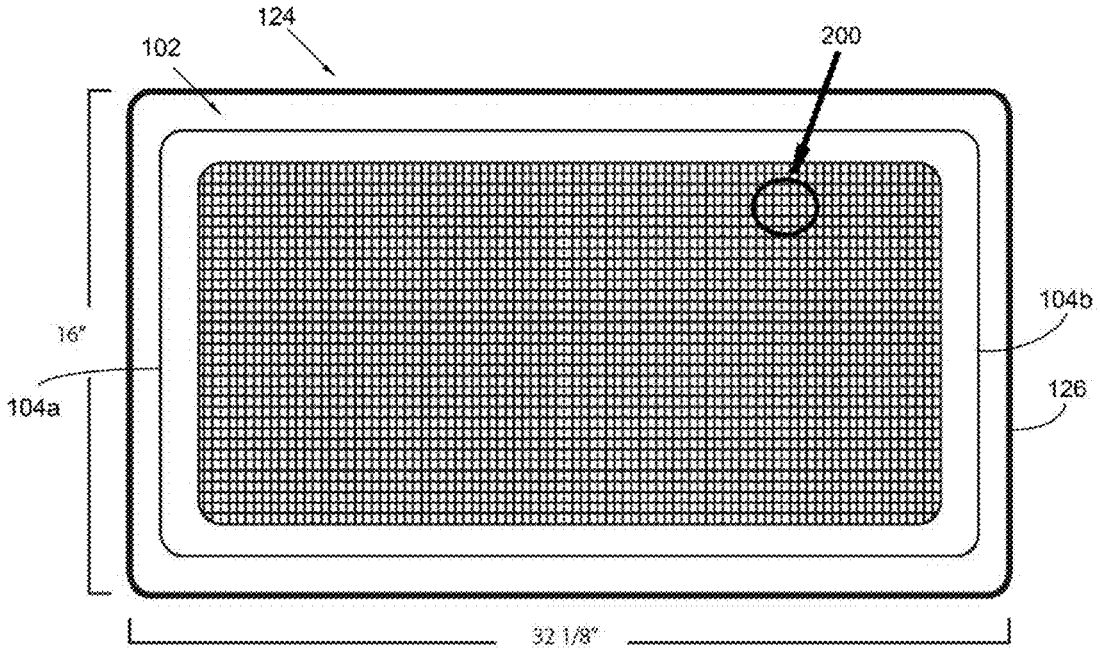
FIG. 2 illustrates a top view of an exemplary large sieve panel, showing the large sieve openings, in accordance with an embodiment of the present invention.

In one embodiment shown in FIG. 2, the topmost panel in the stacked arrangement is a large sieve panel 102. The large sieve panel 102 is defined by a pair of large edges 104*a*, 104*b* and multiple large sieve openings 200. In one non-limiting embodiment, the large sieve panel 102 has dimensions of about 32⅛" long and 16" wide, forming a rectangular shape. The large edges 104*a-b* may have a slick, flat surface, or may have rollers or perpendicular flanges for slidably engaging docking rails 128*a* in a harvesting vehicle 124, as discussed below.

The large sieve panel 102 is configured to capture the largest flowers and trimmings thereof. In one non-limiting embodiment, the large sieve openings 200 are about 1.5" in diameter. The large sieve openings 200 may have circular shape, a rectangular shape, a square shape, or an irregular shape. In another non-limiting embodiment, the large sieve panel 102 is fabricated from a rigid polymer. Though in other embodiments, the large sieve panel 102 may be fabricated from other lightweight materials, including wood, bamboo, polyurethane, polyvinyl chloride, aluminum, and fiberglass.

Figure 3:
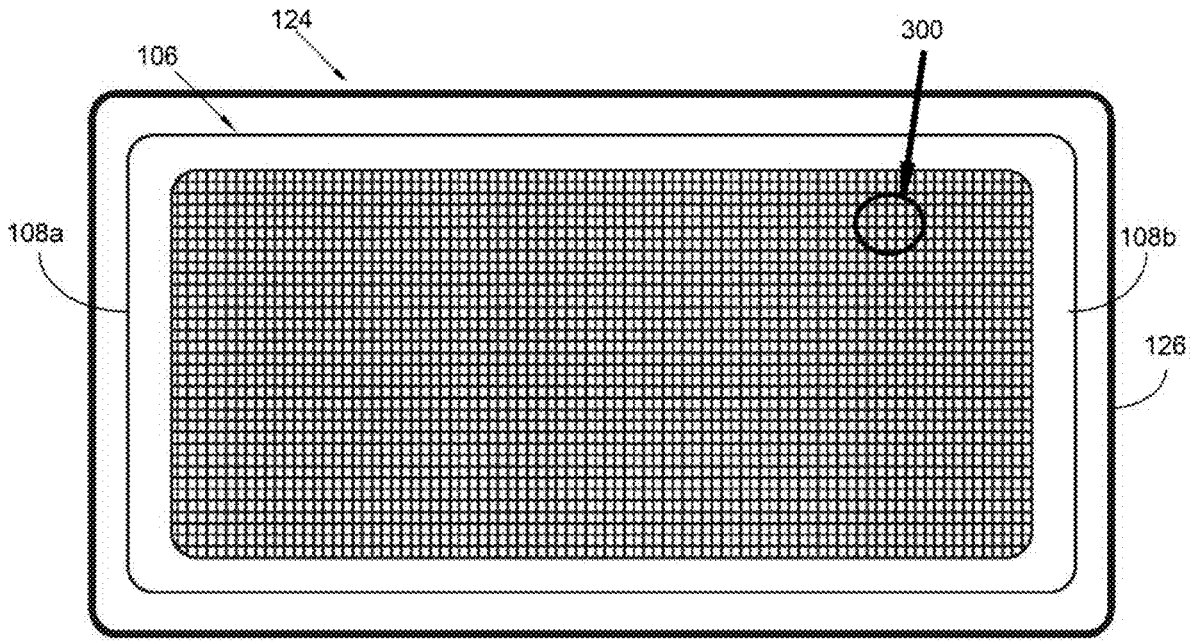
FIG. 3 illustrates a top view of an exemplary medium sieve panel, showing the medium sieve openings, in accordance with an embodiment of the present invention.

Beneath the large sieve panel 102 in the stacked arrangement is a medium sieve panel 106 defined by a pair of medium edges 108*a*, 108*b* and a plurality of medium sieve openings 300 (FIG. 3). The medium sieve panel 106 is configured to capture medium-sized flowers and trimmings that fall through the large sieve openings 200 from above. The distance between the medium sieve panel 106 and the large sieve panel 102 is about 4".

In one non-limiting embodiment, the medium sieve panel 106 has dimensions of about 32⅛" long and 16" wide, forming a rectangular shape. The medium sieve openings 300 are about ¾" in diameter. In some embodiments, the medium sieve openings 300 may have circular shape, a rectangular shape, a square shape, or an irregular shape. In another non-limiting embodiment, the medium sieve panel 106 is fabricated from a rigid polymer. Though in other embodiments, the medium sieve panel 106 may be fabricated from other lightweight materials, including wood, bamboo, polyurethane, polyvinyl chloride, aluminum, and fiberglass.

Figure 4:
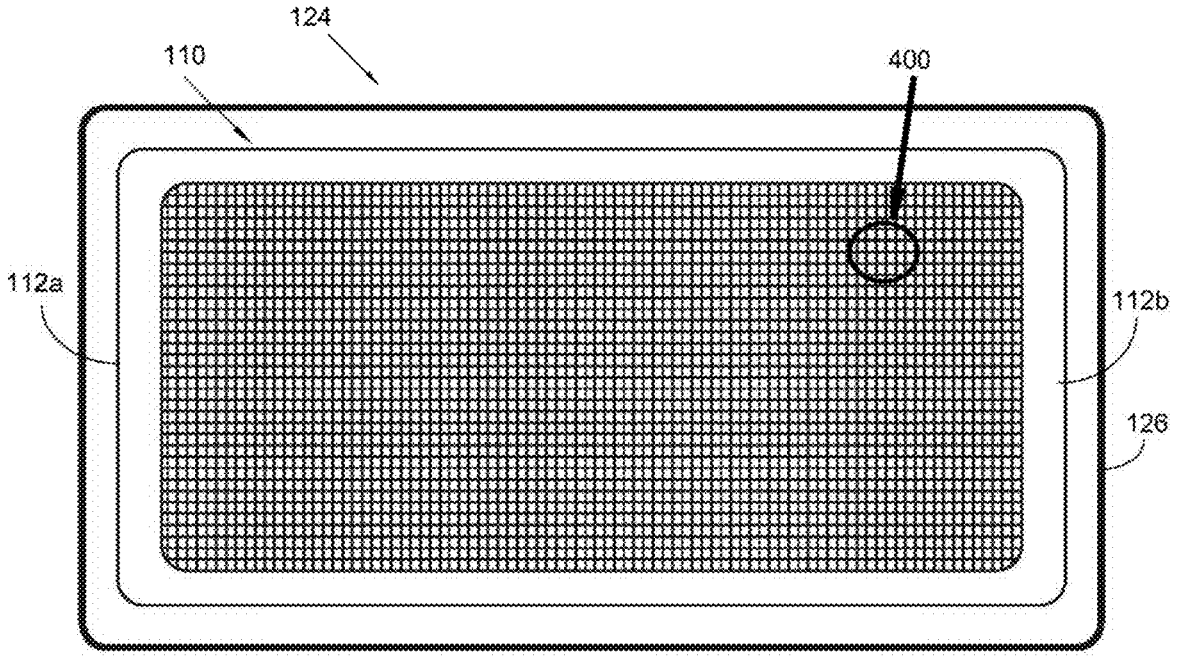
FIG. 4 illustrates a top view of an exemplary small sieve panel, showing the small sieve openings, in accordance with an embodiment of the present invention.

Turning now to FIG. 4, the sieving apparatus 100 also provides a small sieve panel 110 that can be positioned beneath the medium sieve panel 106 in the stacked arrangement. The small sieve panel 110 is defined by a pair of small edges 112*a*, 112*b* and multiple small sieve openings 400. The small sieve panel 110 is configured to capture small-sized flowers and trimmings that fall through the medium sieve openings 300 from above. In one non-limiting embodiment, the distance between the small sieve panel 110 and the medium sieve panel 106 is about 4". In another non-limiting embodiment, the small sieve panel 110 has dimensions of about 32⅛" long and 16" wide.

Looking again at FIG. 4, the small sieve openings 400 are about ⅓" in diameter, which is sufficient top enable passage of smaller trimmings from the cannabis plant. The small sieve openings 400 may have circular shape, a rectangular shape, a square shape, or an irregular shape. In another non-limiting embodiment, the small sieve panel 110 is fabricated from a rigid polymer. Though in other embodiments, the small sieve panel 110 may be fabricated from other lightweight materials, including wood, bamboo, polyurethane, polyvinyl chloride, aluminum, and fiberglass.

Figure 5:
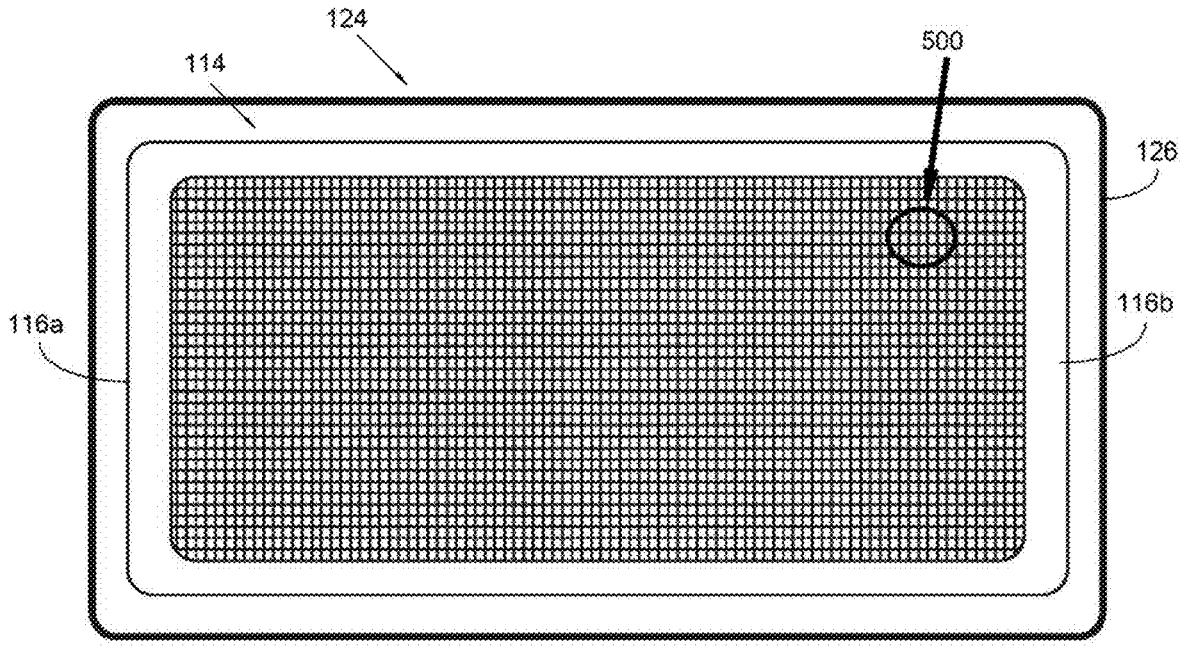
FIG. 5 illustrates a top view of an exemplary silk screen panel, showing the micro-sized sieve openings, in accordance with an embodiment of the present invention.

As referenced in FIG. 5, the sieving apparatus 100 also provides a silk screen panel 114 that enables passage of all but the smallest components of the cannabis plant. The silk screen panel 114 generally positions beneath the small sieve panel 110 in the stacked arrangement. The silk screen panel 114 is defined by a pair of screen edges 116*a*, 116*b*.

The silk screen panel 114 is also defined by multiple micro-sized openings 500 that are substantially smaller than the small sieve openings 400 above. Those skilled in the art will recognize that pollen can be 6 micrometers in size. The silk screen panel 114 is configured to capture the smallest sized flowers and trimmings that fall through the small sieve openings 400; while also enabling passage of substantially all of the pollen and trichomes. Thus, the silk screen panel 114 is sized and dimensioned to enable at least partial passage of pollen and trichomes from the cannabis plant that is being harvested.

In one non-limiting embodiment, the silk screen panel 114 has dimensions of about 32⅛" long and 16" wide. The micro-sized openings 500 are substantially smaller than ⅓" in diameter. The silk screen sieve openings may have circular shape, a rectangular shape, a square shape, or an irregular shape. In another non-limiting embodiment, the silk screen panel 114 is fabricated from a rigid polymer. Though in other embodiments, the silk screen panel 114 may be fabricated from other lightweight materials, including wood, bamboo, polyurethane, polyvinyl chloride, aluminum, and fiberglass.

The distance between the silk screen panel 114 and the small sieve panel 110 is about 3". As discussed above, the sieve panels 102, 106, 110 and the silk screen panel 114 are defined by a graduated separation 122, in which the distance between panels 102, 106, 110, 114 correlate to the size of the flower, trimming, leaf, pollen, or trichomes passing through the holes. The graduated separation 122 creates more space between panels 102, 106 that enable passage of larger components of the cannabis plant, i.e., leaf, trimmings; while reducing space between panels 110, 114 that allow for smaller components, i.e., pollen, trichomes. This creates more efficient spacing inside the harvesting vehicle 124, so as to minimize size and weight.

Figure 6:
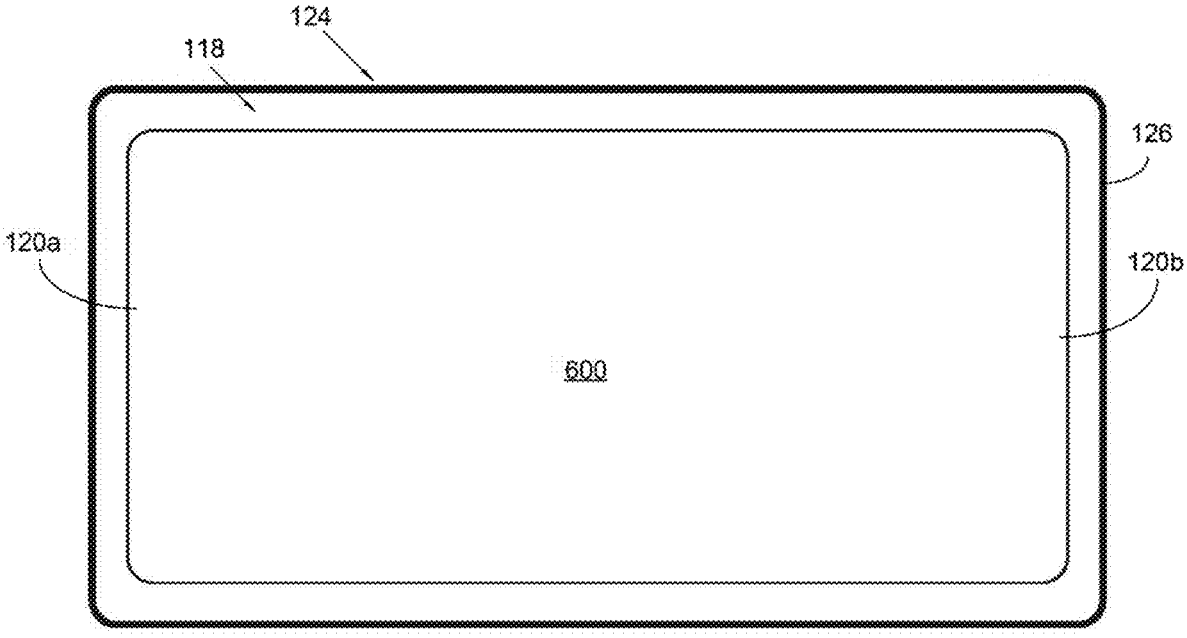
FIG. 6 illustrates a top view of an exemplary harvesting panel, in accordance with an embodiment of the present invention.

Turning now to FIG. 6, beneath the silk screen panel 114 in the stacked arrangement is a harvesting panel 118. The harvesting panel 118 is defined by a pair of harvesting edges 120*a*, 120*b* and a generally flat surface 600 that does not contain openings. The harvesting panel 118 is configured to catch the pollen and trichomes that falls through the silk screen panel 114. The harvesting panel 118 is lightweight and can operate independently for facilitated carrying of the harvested pollen and trichomes. The distance between the silk screen panel 114 and the harvesting panel 118 is about 1".

In one non-limiting embodiment, the harvesting panel 118 is fabricated from a rigid polymer. Though in other embodiments, the harvesting panel 118 may be fabricated from other lightweight materials, including wood, bamboo, polyurethane, polyvinyl chloride, aluminum, and fiberglass.

In one possible embodiment, the panels 102, 106, 110, 114 are arrangeable in a stacked configuration with the large sieve panel 102 at the top end 130*a* of the harvesting vehicle 124. The medium sieve panel 106 is fixedly attached about 4" below the large sieve panel 102. The small sieve panel 110 is fixedly attached about 4" below the medium sieve panel 106. The silk screen panel 114 is fixedly attached about 3" below the small sieve panel 110. The harvesting panel 118 is fixedly attached about 1" below the silk screen panel 114. Each sieve opening is larger than the one below it, with the harvesting panel 118 having no openings, so as to capture the fine pollen and trichomes granules.

In another embodiment, the panels 102, 106, 110, 114 are detachably attached at their edges 104*a-b*, 108*a-b*, 112*a-b*, 116*a-b*, 120*a-b* to the harvesting vehicle 124, so that any one panel can be removed/added/replaced in the stacked arrangement. This creates greater flexibility in selecting the size and position of sieve openings in the stacked arrangement. For example, the small sieve panel 110 can be removed, so that the silk screen panel 118 receives pollens and plant residue directly sieved through the medium sieve panel 106.

The detachable attachment to the harvesting vehicle 124 is through at least one panel fastener 136*a-e*, disposed between the edges of the panels. A first panel fastener 136*a* detachably couples the large sieve panel 102 at one or more edges 104*a-b* to the harvesting vehicle 124. A second panel fastener 136*b* detachably couples the medium sieve panel 106 at one or more edges 108*a-b* to the harvesting vehicle 124. A third panel fastener 136*c* detachably couples the small sieve panel 110 at one or more edges 112*a-b* to the harvesting vehicle 124.

Continuing, a fourth panel fastener 136*d* detachably couples the silk screen panel 114 at one or more edges 116*a-b* to the harvesting vehicle 124. A fifth panel fastener 136*e* detachably couples harvesting panel 118 at one or more edges 120*a-b* to the harvesting vehicle 124. The panel fastener 136*a-e* may include, without limitation, a block fastener, a clasp fastener, a panel lock, a bolt, a draw bolt locking mechanism, a magnet, a screw, and a friction-fit mechanism.

In some embodiments, gravity and an agitating force applied to the harvesting vehicle and panels carries the flowers, trimmings, and pollen and trichomes through the various sieve panels 102, 106, 110, and 114. In other embodiments, a shaking motion or other form of agitation may be used to help break up the trimmings and flowers into smaller pieces, and force the flowers through the sieve openings. In yet other embodiments, a motor, or simple manual force by the hands may be used to create the shaking motion for agitating and breaking up the flowers and trimmings. In any case, the lightweight configuration of the panels 102, 106, 110, 114, 118 and the harvesting vehicle 124 facilitate the agitating motion necessary to sieve the cannabis plant.

Looking back at FIG. 1, the apparatus 100 further comprises an elongated harvesting vehicle 124 that retains the panels 102, 106, 110, 114, 118 in the stacked, graduated arrangement described above. The harvesting vehicle 124 is defined by a lightweight material. The harvesting vehicle 124 has sidewalls 126 and a base 132. In one embodiment, the harvesting vehicle 124 has a generally upright, rectangular shape, with the sidewalls 126 forming an inner volume.

The harvesting vehicle 124 has a top end 130*a* and a bottom end 130*b*, with the top end 130*a* oriented above the bottom end 130*b* when the harvesting vehicle 124 is erected for operation. In one non-limiting embodiment, the elongated harvesting vehicle 124 is about 17¼" in height, 32⅛" in length, and 16" in width. Though other sizes and shapes for the harvesting vehicle 124 may be used.

In some embodiments, a series of spaced-apart docking rails 128*a-e* are disposed longitudinally along the sidewalls 126 of the harvesting vehicle 124. The docking rails 128*a-e* are spaced longitudinally along the inner side of the sidewalls 126 to retain the panels 102, 106, 110, 114, 118 in a graduated, stacked arrangement. The stacked arrangement of panels, as described above, may include the large sieve panel 102 being at the top end 130*a* of a harvesting vehicle 124, and the harvesting panel 118 being at a bottom end 130 of the harvesting vehicle 124. The inner volume of the harvesting vehicle 124 is sized to receive the panels 102, 106, 110, 114, 118 in the stacked arrangement, and also allow for easy viewing and removal of panels from inside the harvesting vehicle 124.

In some embodiments, the edges 104*a-b*, 108*a-b*, 112*a-b*, 116*a-b*, 120*a-b* of the panels 102, 106, 110, 114, 118, and the docking rails 128*a-e* in the harvesting vehicle 124 may engage through a sliding relationship in which the edges, include wheels or corresponding rails that slide or roll along the docking rails 128*a-e*. In other embodiments, the edges of the panels and the docking rails 128*a-e* may engage through a snap-fit relationship in which the rails and edges are friction fit to attach and detach. In either case, the panels 102, 106, 110, 114, 118 to a respective dock rail, so as to quickly and easily attach and detach without the use of tools, external fasteners, or specialized skill sets.

Thus, the relationship between the docking rails 128*a-e* and the edges 104*a-b*, 108*a-b*, 112*a-b*, 120*a-b*, enables efficient assemblage of panels into the stacked arrangement, and interchangeability of panels. This allows for quick changing of sieve panels, for example to increase or decrease the sieve opening diameter. This also allows the harvesting panel 118 to be removed when full and replaced with an empty harvesting panel 118.

In one embodiment, a top docking rail 128*a* slidably engages the pair of large edges 104*a*, 104*b* of the large sieve panel 102. The top docking rail 128*a* is proximal to the top end of the harvesting vehicle. 124 The next lower docking rails 128*b* slidably engage the pair of medium edges 108*a*, 108*b* of the medium sieve panel 106. The next lower docking rails 128*c* slidably engage the pair of small edges 112*a*, 112*b* of the small sieve panel 110.

Continuing with the slidable relationships, the next lower docking rails 128*d* slidably engage the pair of screen edges 116*a*, 116*b* of the silk screen panel 114. The lowest docking rails 128*e* slidably engage the pair of harvesting edges 120*a*, 120*b* of the harvesting panel 118. The harvesting panel 118 also rests on the base 132 of the harvesting vehicle 124. The harvesting panel 118 is proximal to the bottom end 130*b* of the harvesting vehicle 124.

In one embodiment, the elongated harvesting vehicle 124 is fabricated from a rigid polymer that is lightweight. The lightweight material configuration of the elongated harvesting vehicle 124 enables facilitated mobility of the panels after the cannabis plant has been cut and dried and the flowers removed from the stems. Thus, the harvesting vehicle 124 is not actually carried to the actual standing cannabis plant.

In some embodiments, the harvesting vehicle 124 may include a handle 134 or cable/rope for pulling and carrying the harvesting vehicle 124 and internal panels. The handle 134 and lightweight configuration of the harvesting vehicle 124 allows the panels to be carried to a field/greenhouse of cannabis plants for harvesting of the pollen and trichomes.

Figure 7A:
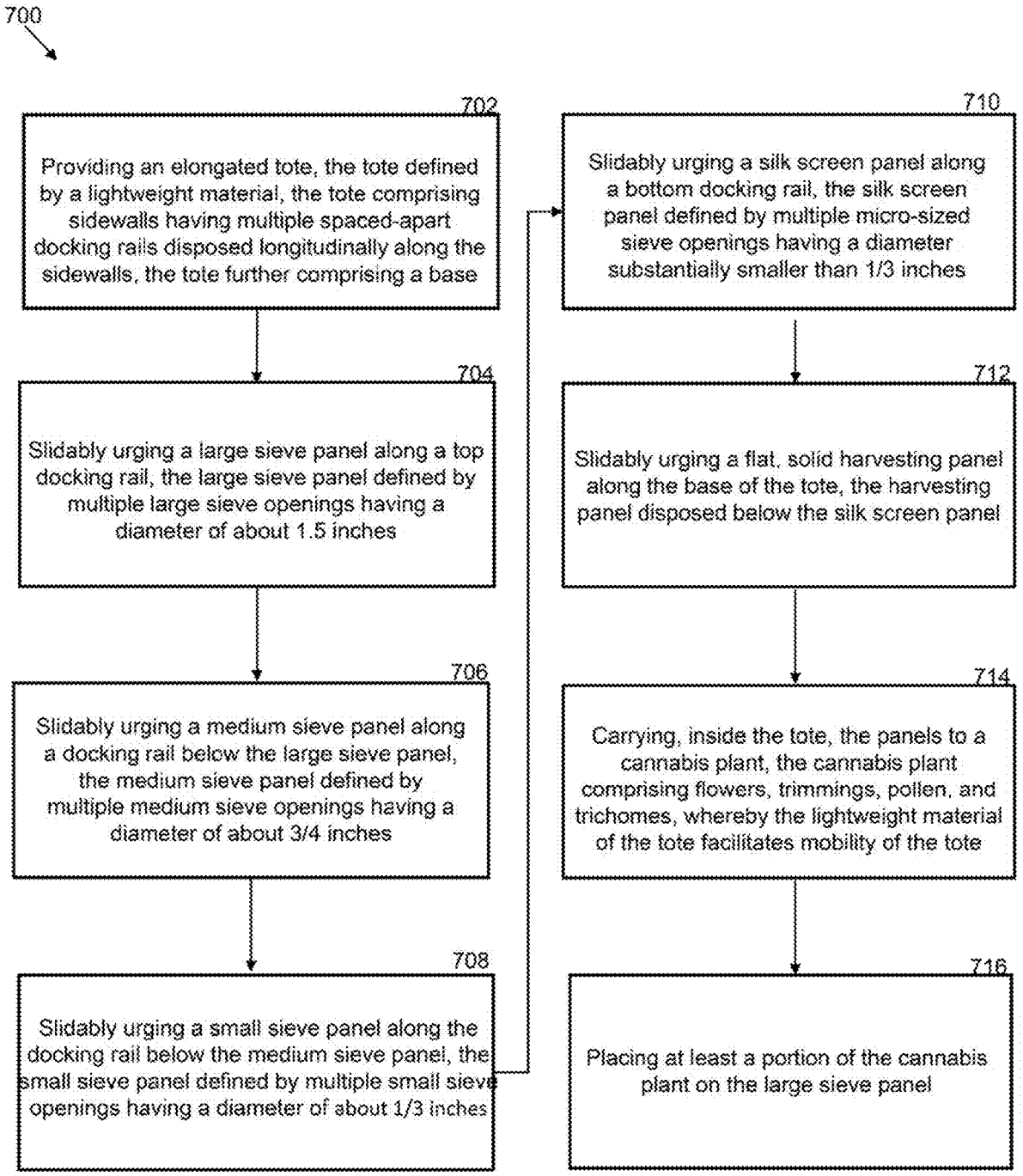
FIGS. 7A and 7B illustrate a flowchart of an exemplary method for harvesting cannabis pollen and trichomes, in accordance with an embodiment of the present invention.
Figure 7B:
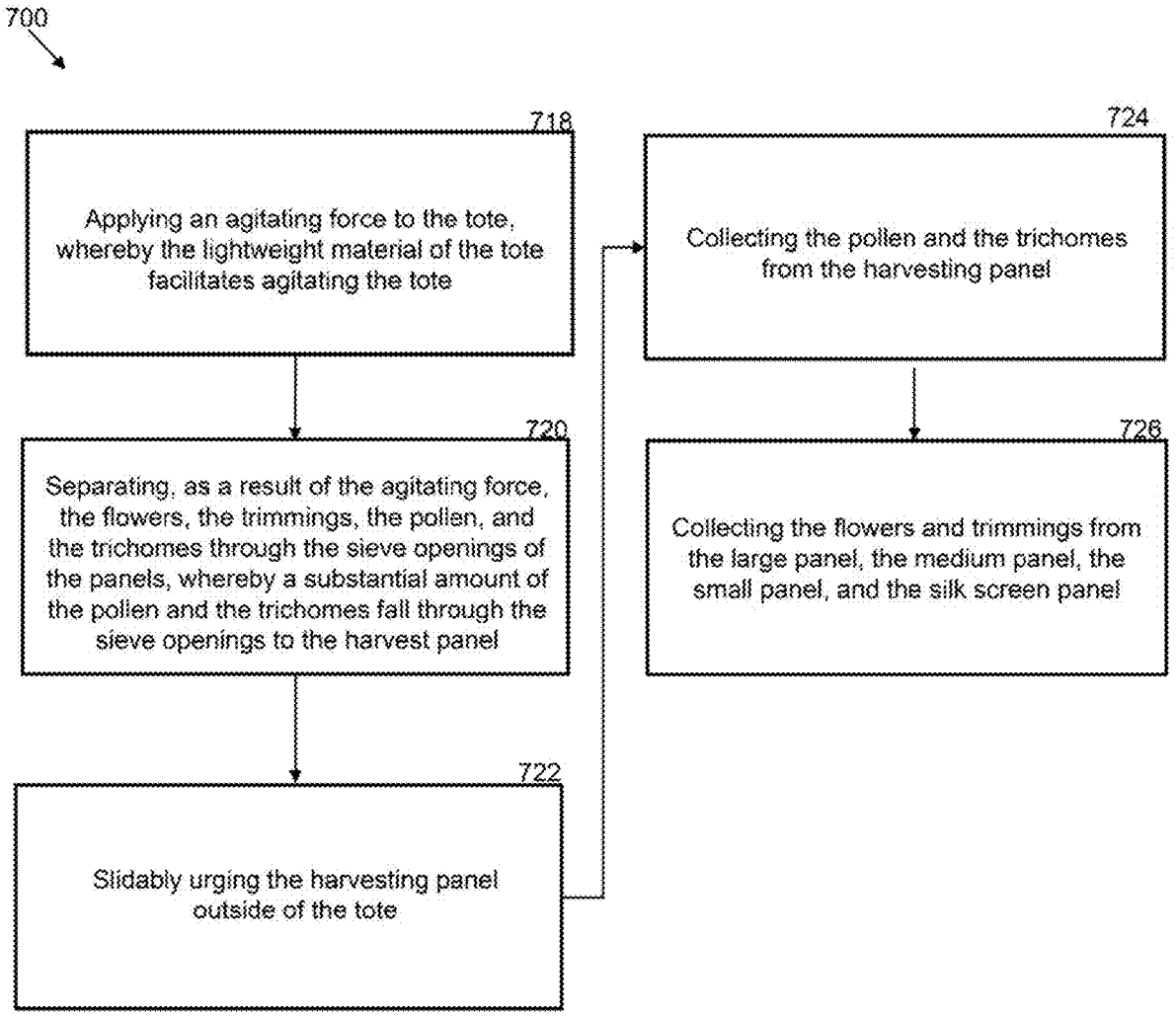

FIGS. 7A and 7B illustrate a flowchart of an exemplary method 700 for harvesting pollen and trichomes. The method 700 may include an initial Step 702 of providing an elongated harvesting vehicle, the harvesting vehicle defined by a lightweight material, the harvesting vehicle comprising sidewalls having multiple spaced-apart docking rails disposed longitudinally along the sidewalls, the harvesting vehicle further comprising a base. The harvesting vehicle 124 that retains the panels 102, 106, 110, 114, 118 in the stacked, graduated arrangement described above. The lightweight material of the harvesting vehicle 124 allows for facilitated mobility and agitation of the panels for sieving.

The method 700 may further comprise a Step 704 of slidably urging a large sieve panel along a top docking rail, the large sieve panel defined by multiple large sieve openings having a diameter of about 1½". A Step 706 includes slidably urging a medium sieve panel along a docking rail below the large sieve panel, the medium sieve panel defined by multiple medium sieve openings having a diameter of about ¾".

In some embodiments, a Step 708 comprises slidably urging a small sieve panel along the docking rail below the medium sieve panel, the small sieve panel defined by multiple small sieve openings having a diameter of about ⅓". A Step 710 includes slidably urging a silk screen panel along a bottom docking rail, the silk screen panel defined by multiple micro-sized sieve openings having a diameter substantially smaller than ⅓".

In some embodiments, a Step 712 may include slidably urging a flat, solid harvesting panel along the base of the harvesting vehicle, the harvesting panel disposed below the silk screen panel. A Step 714 comprises carrying, inside the harvesting vehicle, the panels to a cannabis plant, the cannabis plant comprising flowers, trimmings, pollen, and trichomes, whereby the lightweight material of the harvesting vehicle facilitates mobility of the harvesting vehicle.

In some embodiments, the method 700 may further include a Step 716 of placing at least a portion of the cannabis plant on the large sieve panel. A Step 718 includes applying an agitating force to the harvesting vehicle, whereby the lightweight material of the harvesting vehicle facilitates agitating the harvesting vehicle. The agitating force can be manual, or through automated mechanical means known in the art of sieving.

The method 700 also includes a Step 720 of separating, as a result of the agitating force, the flowers, the trimmings, the pollen, and the trichomes through the sieve openings of the panels, whereby a substantial amount of the pollen and the trichomes fall through the sieve openings to the harvest panel. Another Step 722 includes slidably urging the harvesting panel outside of the harvesting vehicle. A Step 724 may include collecting the pollen and the trichomes from the harvesting panel. The harvesting panel 118 can be slid out of the docking rail 128*e* and the base 132 to enable access to the pollen and trichomes. A final Step 726 comprises collecting the flowers and trimmings from the large panel, the medium panel, the small panel, and the silk screen panel.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A sieving apparatus for harvesting cannabis pollen and trichomes, the apparatus comprising:

a large sieve panel defined by a pair of large edges and multiple large sieve openings having a diameter of about 1.5 inches;

a medium sieve panel defined by a pair of medium edges and multiple medium sieve openings having a diameter of about ¾ inches;

a small sieve panel defined by a pair of small edges and multiple small sieve openings having a diameter of about ⅓ inches;

a silk screen panel defined by a pair of screen edges and multiple micro-sized sieve openings having a diameter substantially smaller than ⅓ inches;

a harvesting panel defined by a pair of harvesting edges and a flat surface; and a harvesting vehicle defined by a lightweight material, the harvesting vehicle comprising sidewalls having multiple spaced-apart docking rails disposed longitudinally along the sidewalls, the docking rails slidably receiving the edges of the panels, the docking rails retaining the panels in a graduated, stacked, and spaced-apart arrangement, the harvesting vehicle further comprising a base, whereby the lightweight material of the harvesting vehicle facilitates mobility of the panels, and agitation of the harvesting vehicle, whereby the large sieve panel slides along a top docking rail, the silk screen panel slides along a bottom docking rail, the medium sieve panel slides along a docking rail below the top docking rail, the small sieve panel slides along a docking rail above the bottom docking rail, and the harvesting panel slides along the base, whereby the sieve panels and the silk screen panel are defined by a graduated separation, whereby the panels are removable from the harvesting vehicle.

2. The apparatus of claim 1, wherein the distance between the large sieve panel and the medium sieve panel is about 4 inches.

3. The apparatus of claim 2, wherein the distance between the medium sieve panel and the small sieve panel is about 4 inches.

4. The apparatus of claim 3, wherein the distance between the small sieve panel and the silk screen sieve panel is about 3 inches.

5. The apparatus of claim 4, wherein the distance between the silk screen panel and the harvesting panel is about 1 inch.

6. The apparatus of claim 1, wherein the panels have a length of about 32⅛ inches and a width of about 16 inches.

7. The apparatus of claim 1, wherein the harvesting vehicle comprises a top end and a bottom end having a base, the base disposed below the bottom docking rail.

8. The apparatus of claim 7, wherein the base supports the harvest panel.

9. The apparatus of claim 1, wherein the harvesting vehicle has a height of about 17¼ inches and a width of about 32⅝ inches.

10. The apparatus of claim 1, wherein the silk screen panel is sized and dimensioned to enable at least partial passage of pollen and trichomes from a cannabis plant.

11. The apparatus of claim 1, wherein the sieve panels are fabricated from at least one of the following: a rigid polymer, wood, and a lightweight metal.

12. The apparatus of claim 1, wherein the harvesting vehicle is fabricated from at least one of the following: a rigid polymer, wood, and a lightweight metal.

13. The apparatus of claim 1, wherein the edges of the panels include at least one of the following: a slick, flat surface, a plurality of rollers, and a perpendicular flange.

14. The apparatus of claim 1, further comprising at least one panel fastener, the panel fastener disposed between the edges of the panels and the harvesting vehicle.

15. A sieving apparatus for harvesting cannabis pollen and trichomes, the apparatus consisting of:

a large sieve panel defined by a pair of large edges and multiple large sieve openings having a diameter of about 1.5 inches;

a medium sieve panel defined by a pair of medium edges and multiple medium sieve openings having a diameter of about ¾ inches, whereby the distance between the large sieve panel and the medium sieve panel is about 4 inches;

a small sieve panel defined by a pair of small edges and multiple small sieve openings having a diameter of about ⅓ inches, whereby the distance between the medium sieve panel and the small sieve panel is about 4 inches;

a silk screen panel defined by a pair of screen edges and multiple micro-sized sieve openings having a diameter substantially smaller than ⅓ inches, whereby the sieve panels and the silk screen panel are defined by a graduated separation;

a harvesting panel defined by a pair of harvesting edges and a flat surface, whereby the distance between the silk screen panel and the harvesting panel is about 1 inch; and an elongated harvesting vehicle defined by a lightweight material, the harvesting vehicle comprising sidewalls having multiple spaced-apart docking rails disposed longitudinally along the sidewalls, the docking rails slidably receiving the edges of the panels, the docking rails retaining the panels in a graduated, stacked, and spaced-apart arrangement, the harvesting vehicle further comprising a top end and a bottom end having a base, the harvesting vehicle further comprising a handle, the elongated harvesting vehicle being fabricated from at least one of the following: a rigid polymer, wood, and a lightweight metal, whereby the lightweight material of the harvesting vehicle facilitates mobility of the panels, and agitation of the harvesting vehicle, whereby the large sieve panel slides along a top docking rail, the silk screen panel slides along a bottom docking rail, the medium sieve panel slides along a docking rail below the top docking rail, the small sieve panel slides along a docking rail above the bottom docking rail, and the harvesting panel slides along the base, whereby the panels are removable from the harvesting vehicle.

16. The apparatus of claim 15, wherein the panels have a length of about 32⅛ inches and a width of about 16 inches.

17. The apparatus of claim 15, further comprising at least one panel fastener, the panel fastener disposed between the edges of the panels and the harvesting vehicle.

18. The apparatus of claim 15, wherein the edges of the panels include at least one of the following: a slick, flat surface, a plurality of rollers, and a perpendicular flange.

19. The apparatus of claim 15, wherein the silk screen panel is sized and dimensioned to enable at least partial passage of pollen and trichomes from a cannabis plant.

20. A method for harvesting cannabis pollen and trichomes, the method comprising:

providing an elongated harvesting vehicle, the harvesting vehicle defined by a lightweight material, the harvesting vehicle comprising sidewalls having multiple spaced-apart docking rails disposed longitudinally along the sidewalls, the harvesting vehicle further comprising a base;

slidably urging a large sieve panel along a top docking rail, the large sieve panel defined by multiple large sieve openings having a diameter of about 1.5 inches;

slidably urging a medium sieve panel along a docking rail below the large sieve panel, the medium sieve panel defined by multiple medium sieve openings having a diameter of about ¾ inches;

slidably urging a small sieve panel along the docking rail below the medium sieve panel, the small sieve panel defined by multiple small sieve openings having a diameter of about ⅓ inches;

slidably urging a silk screen panel along a bottom docking rail, the silk screen panel defined by multiple micro-sized sieve openings having a diameter substantially smaller than ⅓ inches;

slidably urging a flat, solid harvesting panel along the base of the harvesting vehicle, the harvesting panel disposed below the silk screen panel;

carrying, inside the harvesting vehicle, the panels to a cannabis plant, the cannabis plant comprising flowers, trimmings, pollen, and trichomes, whereby the lightweight material of the harvesting vehicle facilitates mobility of the harvesting vehicle;

placing at least a portion of the cannabis plant on the large sieve panel;

applying an agitating force to the harvesting vehicle, whereby the lightweight material of the harvesting vehicle facilitates agitating the harvesting vehicle;

separating, as a result of the agitating force, the flowers, the trimmings, the pollen, and the trichomes through the sieve openings of the panels, whereby a substantial amount of the pollen and the trichomes fall through the sieve openings to the harvest panel;

slidably urging the harvesting panel outside of the harvesting vehicle;

collecting the pollen and the trichomes from the harvesting panel; and collecting the flowers and trimmings from the large panel, the medium panel, the small panel, and the silk screen panel.

* * * * *